US006090262A

United States Patent [19]

Ide et al.

[11] Patent Number: 6,090,262

[45] Date of Patent: Jul. 18, 2000

[54] BARREL PLATING METHOD

[75] Inventors: Masaaki Ide, Komaki; Takamasa Suzuki, Kounan, both of Japan; Naoki Shamoto, Indianapolis, Ind.

[73] Assignees: Kabushiki Kaisya Aoyama Seisakusyo, Japan; Indiana Automotive Fasteners, Inc.

[21] Appl. No.: 09/163,560

[22] Filed: Sep. 30, 1998

[51] Int. Cl.[7] ..... C25D 5/00; C25D 7/00; C25D 21/12; C25B 15/00

[52] U.S. Cl. ..... 205/143; 205/145; 205/81; 205/83; 204/228.1; 204/228.7

[58] Field of Search ..... 205/143, 145, 205/81, 83; 204/228.1, 228.7

[56] References Cited

U.S. PATENT DOCUMENTS 4,497,695 2/1985 Shinkai et al. ..... 204/28
4,769,117 9/1988 Shiono et al. ..... 204/214
4,822,468 4/1989 Kanehiro ..... 204/213

*Primary Examiner*—Edna Wong
*Attorney, Agent, or Firm*—Parkhurst & Wendell, L.L.P.

[57] ABSTRACT

A barrel plating method wherein each box containing pieces to be plated is provided with a kanban corresponding to the pieces contained in the box. The kanban of each box is read by an apparatus before the pieces are transferred from the box to a plating barrel, so that a plating coefficient corresponding to the information read from the kanban is retrieved from a host computer in which plating coefficients for various kinds of pieces are stored. The plating coefficient retrieved corresponding to the kanban of each box is proportional to a value of plating current to be supplied to a unit weight of pieces contained in the box. A value of plating current for each barrel is automatically calculated by multiplying the plating coefficient by the measured weight of the pieces put in the barrel. Barrel plating is performed by supplying each barrel with the value of the calculated plating current from power sources that correspond in number to barrels that are subjected to a plating process at a given time.

3 Claims, 14 Drawing Sheets

| FIG. 7A | FIG. 7B | FIG. 7C |
|---|---|---|

BARREL PLATING METHOD

BACKGROUND OF THE INVENTION

1. Field of the Invention

The present invention relates to a method for barrel plating by sequentially dipping a variety of small pieces of different sizes and kinds, such as nuts and bolts stored in a plurality of barrels, into various treatment tanks.

2. Description of the Related Art

Barrel plating apparatuses have been widely used for zinc-plating or the like of small pieces, such as nuts, bolts, and the like. An example of such barrel plating apparatuses is disclosed in U.S. Pat. No. 4,769,117. This disclosed barrel plating apparatus has a plurality of barrels for containing small pieces, and performs plating by sequentially dipping the barrels into several treatment tanks, such as a rinse tank, a degreasing tank, an acid cleaning tank, a neutralizing tank, a plating tank, another rinse tank, etc., while rotating the barrels. The pieces contained in the barrels are supplied with plating current from electrodes provided in the barrels, while the barrels are dipped into the plating tank.

In order to perform good plating, it is necessary optimally to control the plating current. For small pieces, such as nuts, bolts and the like, empirically obtained plating current values for representative sizes are stored in a table. Based on data in the table, an operator sets a value of the plating current with appropriate correction based on the operator's own empirical knowledge. However, this conventional method has a problem with variations in the setting of plating current by different operators, resulting in inconsistent plating quality.

When plating nuts and bolts used for motor vehicles, it often becomes necessary to plate many types of items in a continuous operation by placing each type of item into separate barrels, rather than serially plating a single type of nut or bolt contained in many barrels. This prior art manual plating current setting method requires an operator to set a plating current for each of various items that continually arrive at an input station. Thus, the prior art method is likely to cause human error when setting the plating current.

Furthermore, in a typical conventional barrel plating apparatus, the power sources for supplying plating current to barrels are not in one-to-one correspondence with the barrels. That is, one power source supplies plating current to a plurality of barrels. Therefore, if neighboring barrels contain different types of items that considerably differ in the required plating current per barrel, the plating film thickness of pieces can become excessively thick in one barrel and too thin in another barrel. Consequently, it becomes difficult to employ a plating method in which each barrel contains a different type of items.

SUMMARY OF THE INVENTION

Accordingly, it is an object of the present invention to provide a barrel plating method that makes it possible to plate various kinds of small pieces such as nuts, bolts and the like to their optimal coating film thicknesses without relying on the empirical knowledge of an operator.

Another object of the invention is to provide a barrel plating method that makes it possible to set an optimal plating condition for each of the different types of pieces that are contained in different barrels.

In a preferred embodiment of the invention, plating coefficients corresponding to the item numbers of various kinds of pieces are registered in a host computer. Each plating coefficient is proportional to a value of plating current to be supplied to a unit weight of pieces of the corresponding item number, whose value is obtained by multiplying the surface area per piece, the number of pieces per unit weight, and the current density suitable for the pieces. Each box containing platable pieces is provided with a kanban or just-in-time management sheet corresponding to the item number of the pieces contained in the box. A plating apparatus reads the item number from the kanban of each box, so that the apparatus retrieves from a computer, the plating coefficient corresponding to the item number read from the kanban, before the pieces are transferred from the box to a barrel. Subsequently, a value of plating current for each barrel is automatically calculated by multiplying a measured weight of pieces to be put into each barrel by the plating coefficient corresponding to the pieces. Finally, barrel plating is performed by supplying each barrel with the calculated value of plating current from power sources that correspond in number to the numbering barrels that are conducting a plating process at a given time.

Therefore, an operator uses the apparatus to read data from the kanban in or attached to each box. Then, the apparatus automatically calculates a value of plating current for each barrel, and performs plating to an optimal film thickness set separately for each barrel. In a preferred embodiment, the item number of each kind of piece is indicated by a barcode, and read by a barcode reader.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENT

A preferred embodiment of the present invention is described in detail hereinafter with reference to the accompanying drawings. The barrel plating described below is merely illustrative of one type of apparatus that can be used with this method. The invention may be applied to other types of barrel plating apparatuses.

Figure 1:
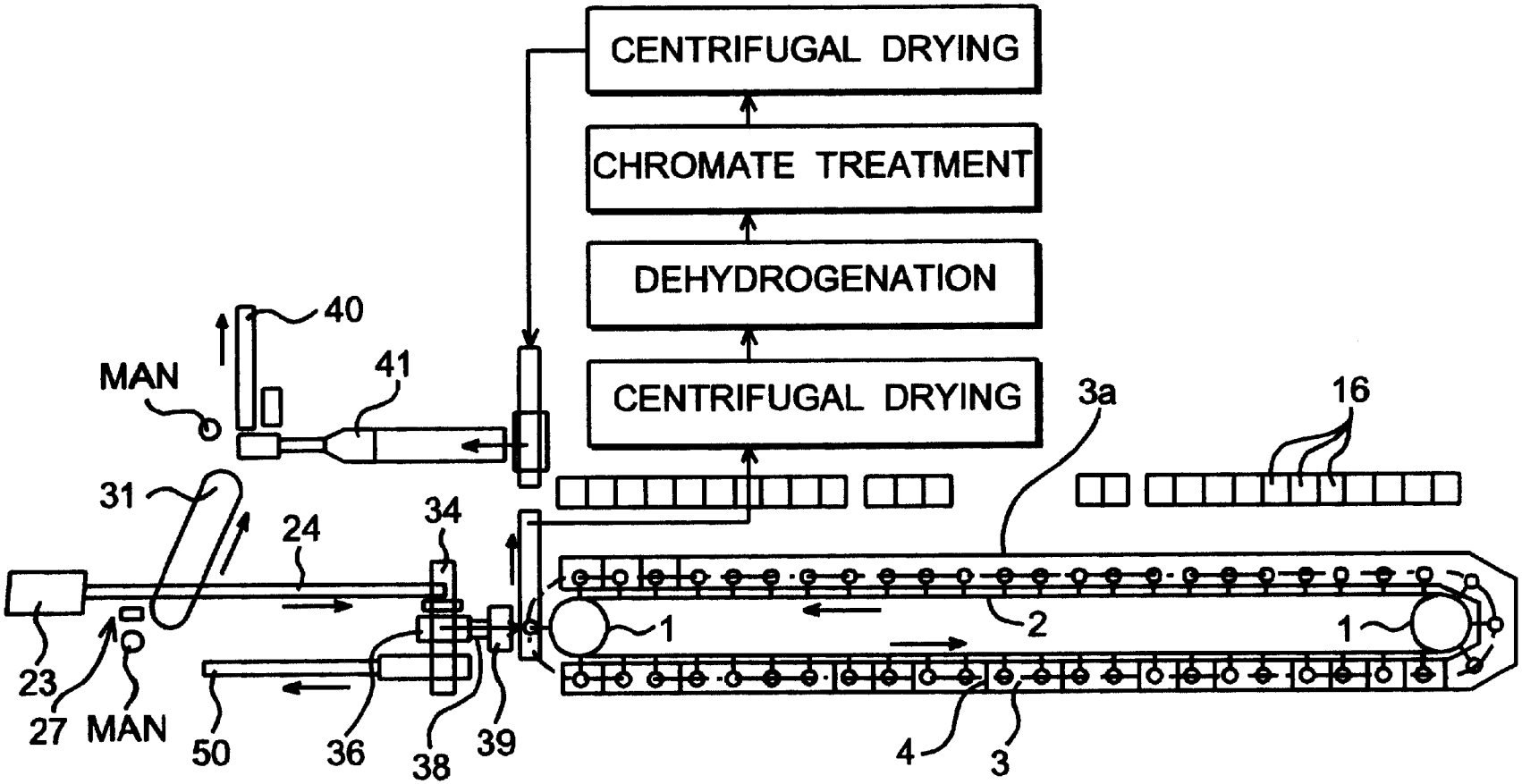
FIG. 1 is a schematic entire plan view of a barrel plating apparatus used in a preferred embodiment of the invention.

Referring to FIG. 1, a barrel plating apparatus according to the embodiment includes endless chains 2 extending horizontally between two large-diameter sprockets 1 whose rotating axes extend, vertically, and a plurality of treatment tanks 3 arranged along the endless chains 2. The treatment tanks 3 are separated by partitions 4, and arranged in an order, for example, a rinse tank, a degreasing tank, an acid cleaning tank, a neutralizing tank, a plating tank, another rinse tank, etc., starting from an entrance. In this embodiment plating tank 3*a* is used for zinc plating.

Figure 2:
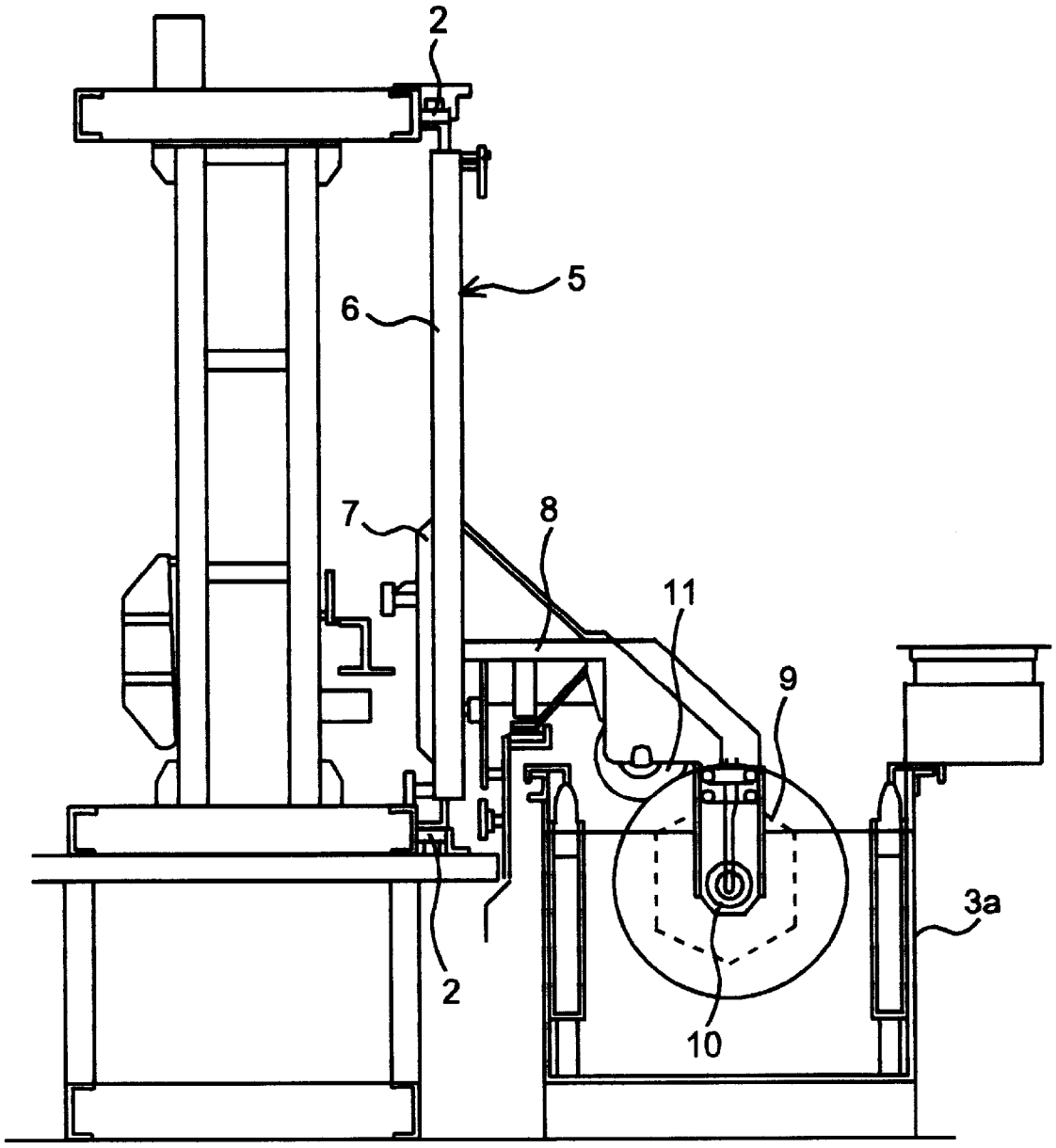
FIG. 2 is a side view of the barrel plating apparatus shown in FIG. 1, where a barrel is dipped into a plating tank.

As shown in FIG. 2, the two endless chains 2 form an upper endless chain and a lower endless chain. Many carriers 5 are connected between the upper and lower endless chains 2, and the carriers 5 extend vertically. The carriers 5 may be arranged equidistantly along the endless chains 2. By intermittently rotating the sprockets 1*a*, 1*b* by using a drive mechanism (not shown), the carriers 5 are moved horizontally at constant time intervals.

As shown in FIG. 2, each carrier 5 has a vertical column 6 to which an elevating carriage 7 is movably connected for up and down movement. The elevating carrier 7 is provided with an arm 8 extending toward the treatment tanks 3. A barrel 9 is connected to a lower distal end portion of the arm 8 in such a manner that the barrel 9 is rotatable about a horizontal shaft 10. The barrel 9 contains pieces to be plated, such as bolts, nuts or the like. The barrel 9 has small holes (not shown) through which treatment liquids enter the interior of the barrel 9. Each barrel 9 is rotated by a drive gear 11 while placed in a treatment tank 3. In FIG. 1, the stop positions of each barrel 9 are indicated by small circles.

Figure 3:
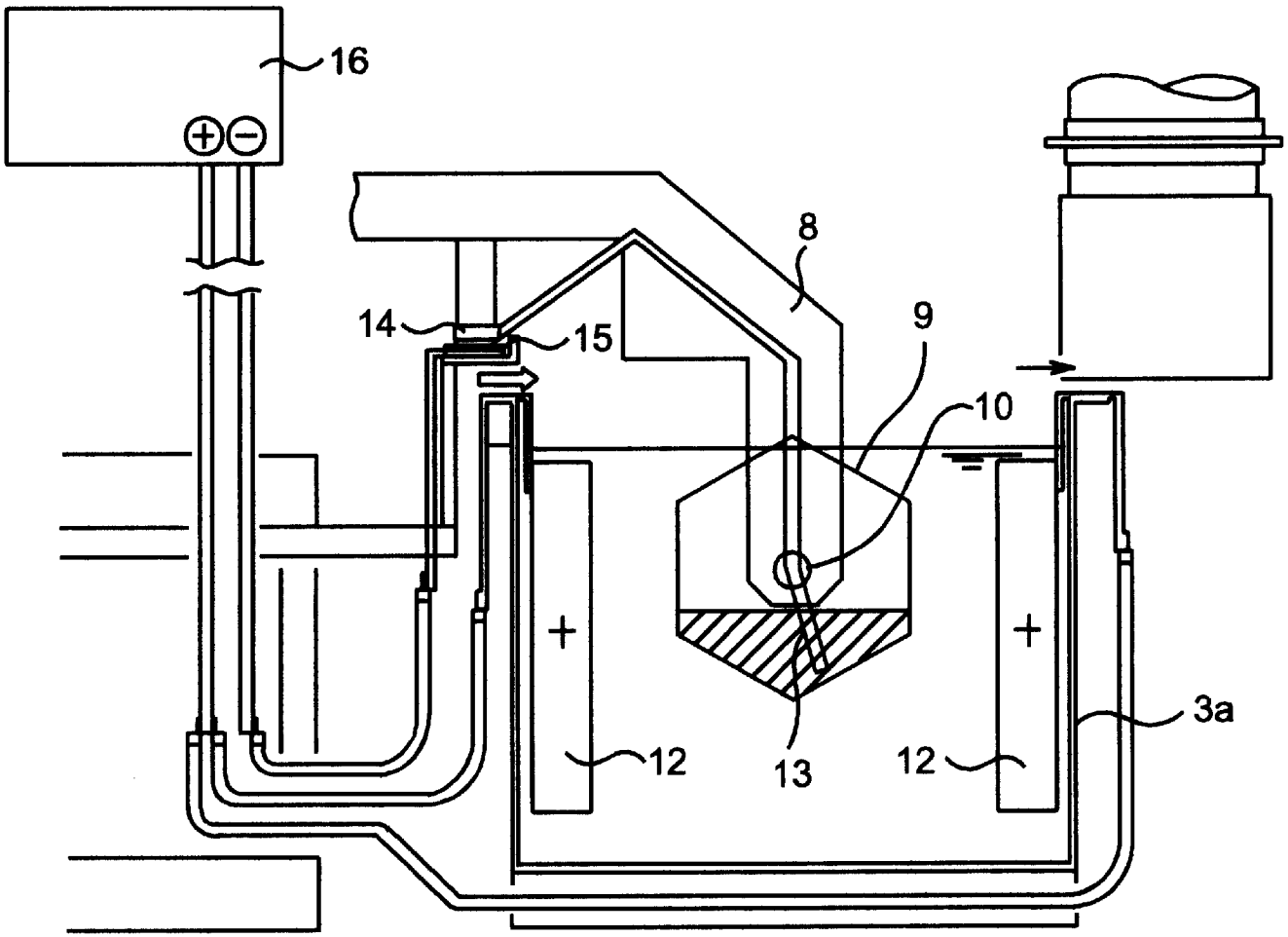
FIG. 3 is a sectional view of the barrel plating apparatus, illustrating an electric power supply system.

As shown in FIG. 3, anodes (zinc electrodes) 12 are submerged at opposite sides of each treatment tank 3. In each barrel, a cathode 13 extends downward through horizontal shaft 10, and contacts pieces to be plated. The cathode 13 is connected to a contact piece 14 provided in a lower portion of arm 8. When an elevating carriage 7 is lowered toward a treatment tank 3, the contact piece 14 contacts an electricity supply bar 15 provided on top of a side wall of treatment tank 3 to supply plating current to the pieces in the barrel 9.

Power sources 16 are located at a side of treatment tanks 3. Normally, each power source 16 is a plating rectifier. According to the invention, the power sources 16 are provided corresponding on a one-to-one basis to at least the barrels 9 that are dipped in the plating tank 3*a*, one at a time, as shown in FIG. 1. In this embodiment, twenty-six power sources 16 are provided as shown in FIG. 1. Twenty-three power sources 16 correspond on a one-to-one basis with twenty-three barrels 9 that are dipped within the plating tank 3*a*, one at a time. The barrels are intermittently moved in a horizontal direction by the endless chains 2 as described above. With regard to a single barrel 9, the power source that supplies current to the barrel 9 actually shifts from one power source 16 to the next power source 16 as the barrel 9 is moved. Therefore, to supply a constant current to one barrel 9 during the run through the plating tank 3*a*, the information regarding the value of plating current to be supplied to the barrel 9 is shifted from the first power source 16 regarding the plating tank 3*a* sequentially to the following twenty-two power sources 16, synchronously with the movement of the barrel 9.

Figure 4:
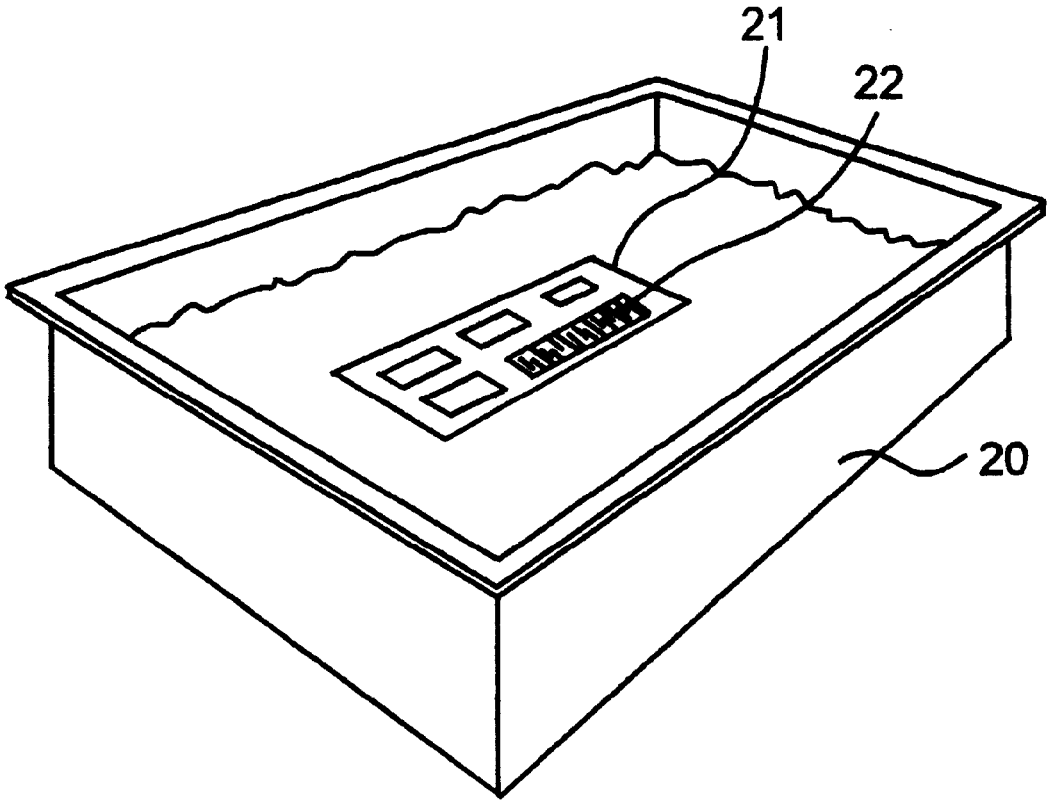
FIG. 4 is a perspective view of a box containing pieces to be plated by the barrel plating apparatus.

As shown in FIG. 4, pieces such as nuts, bolts or the like are placed in resin molded boxes 20 separately in accordance with the kinds of pieces. A kanban or just-in-time management sheet 21 is attached to or put in each box 20. The kanban 21 of each box 20 carries thereon written information regarding the pieces contained in that box, such as the item number, shape and the like thereof. The kanban 21 is attached to or put into the box 20 in a step preceding the plating process.

Figure 9:
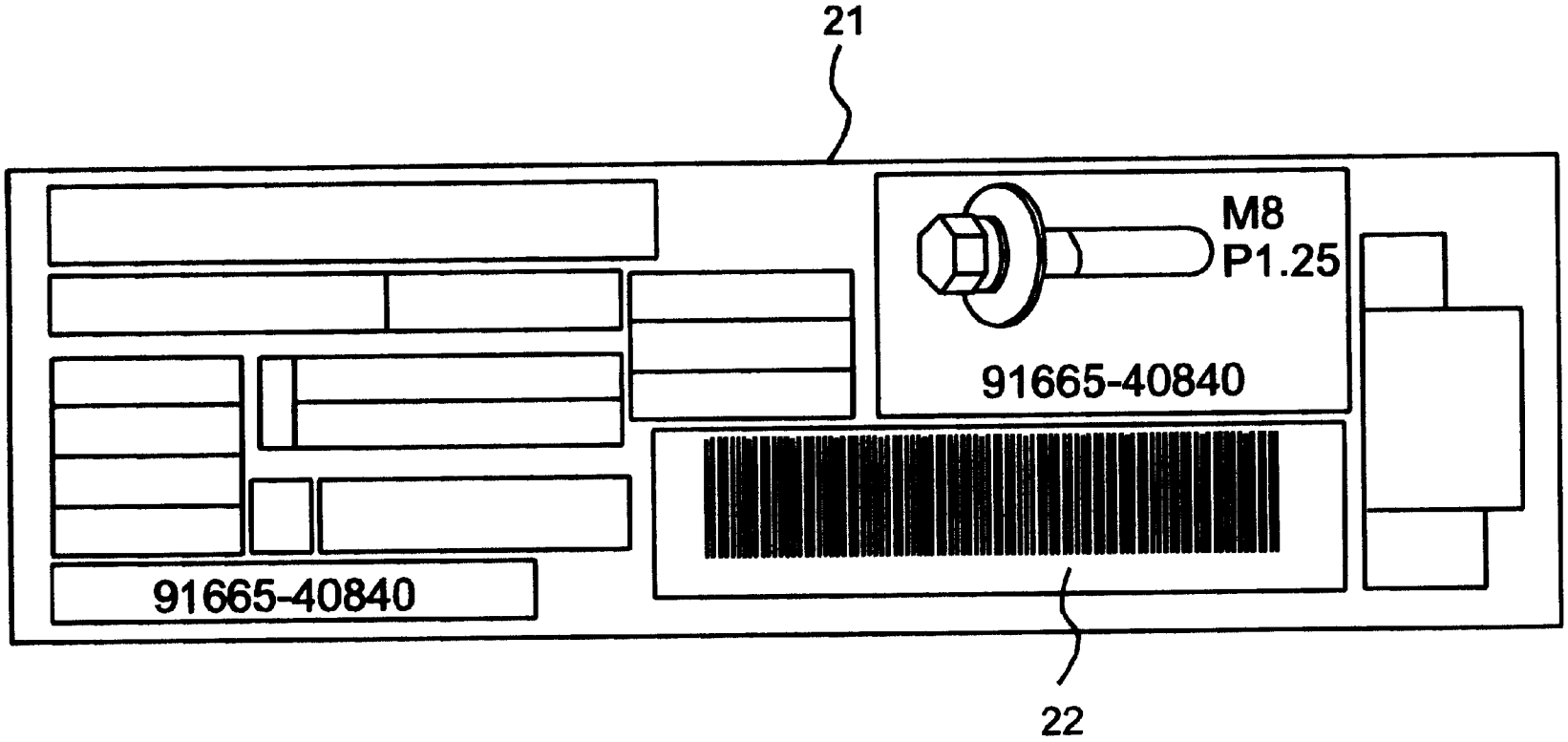
FIG. 9 is a plan view of an example of a kanban used in an embodiment of the invention.

An example of the kanban 21 is shown in FIG. 9. Management of the entire production process using such kanbans is practiced. In addition to providing advantages of the kanban known in the prior art, the present invention utilizes kanbans to provide the operator with the proper plating coefficient. More specifically, the kanban 21 in this embodiment carries thereon a barcode 22 that provides information including the item number of the piece. By using a barcode reader 28 to read the item number from the barcode 22, an operator uses the plating apparatus to retrieve the plating coefficient of the item, as well as the size, weight and the like thereof, from a host computer in which such information is earlier stored separately in accordance with the item numbers.

The plating coefficient is proportional to a value of current per unit weight of the item contained in each box. The plating coefficient for the pieces contained in each box is obtained by multiplying the average surface area X ($dm^2$) of each piece contained in the box, the number Y ($kg^{-1}$) of pieces per unit weight, and the plating current density Z ($A/dm^2$) suitable for the pieces. Therefore, the plating coefficient has dimensions $A/dm^2$. When an item is designed, the surface area X ($dm^2$) per piece of each item and the plating current density Z ($A/dm^2$) suitable for the item can be determined. The number Y of pieces per unit weight is obtained as the reciprocal of the weight of each piece. Therefore, the plating coefficient of each kind of piece or each item, as well as the size, weight and the like thereof, can be determined in the designing stage of the item. If such information regarding items is stored in the host computer, the information can easily be retrieved by using the corresponding kanban 21.

Figure 10:
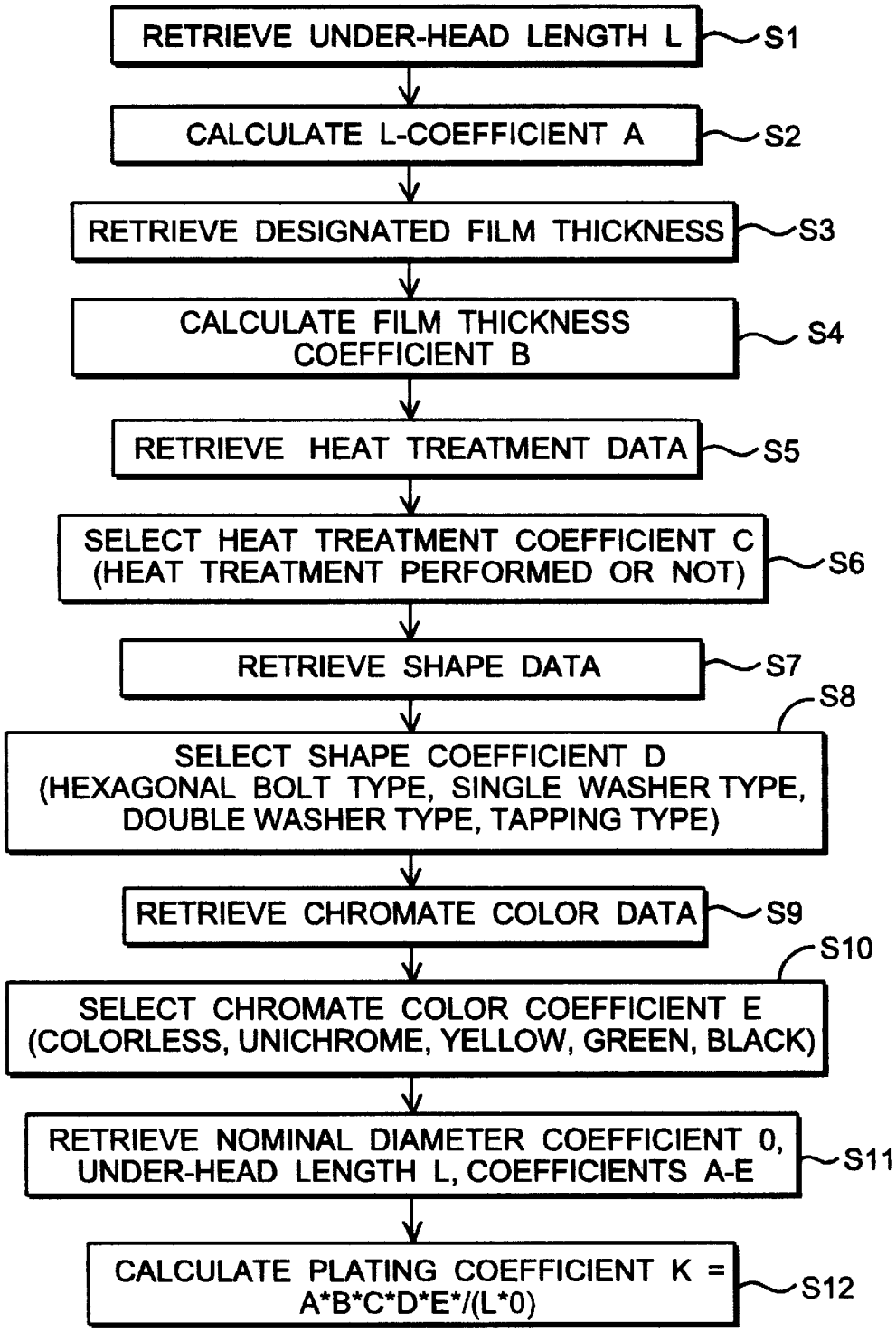
FIG. 10 schematically illustrates a procedure of calculating a plating coefficient.

FIG. 10 schematically shows a procedure for automatically setting a plating coefficient for a bolt. In step S1, the under-head length L is retrieved based on the bolt design values. An L-coefficient A is calculated in step S2. A designated film thickness is retrieved in step S3, and a film thickness coefficient B is calculated in step S4. Heat treatment data is retrieved in step S5, and a heat treatment coefficient C is calculated in step S6. Shape data is retrieved in step S7, and a shape coefficient D is calculated in step S8. Chromate color data is retrieved in step S9, and a chromate color coefficient E is calculated in step S10. A nominal diameter O is retrieved in step S11, and a plating coefficient K is calculated by an equation $K=A*B*C*D*E/(L*O)$ in step S12. The plating coefficient K involves the length L and nominal diameter O of the bolt as variants. The coefficients A, B, C, D, E are determined so that the value of the plating coefficient K becomes proportional to the value of plating current per unit weight of pieces (bolts).

In the procedure shown in FIG. 10, the heat treatment data and the chromate color data are retrieved because each item processed by the barrel plating apparatus according to this embodiment is subjected to a chromate treatment and baking. If these post-treatment processes are omitted, the retrieval of heat treatment data and chromate color data can be omitted.

Figure 5:
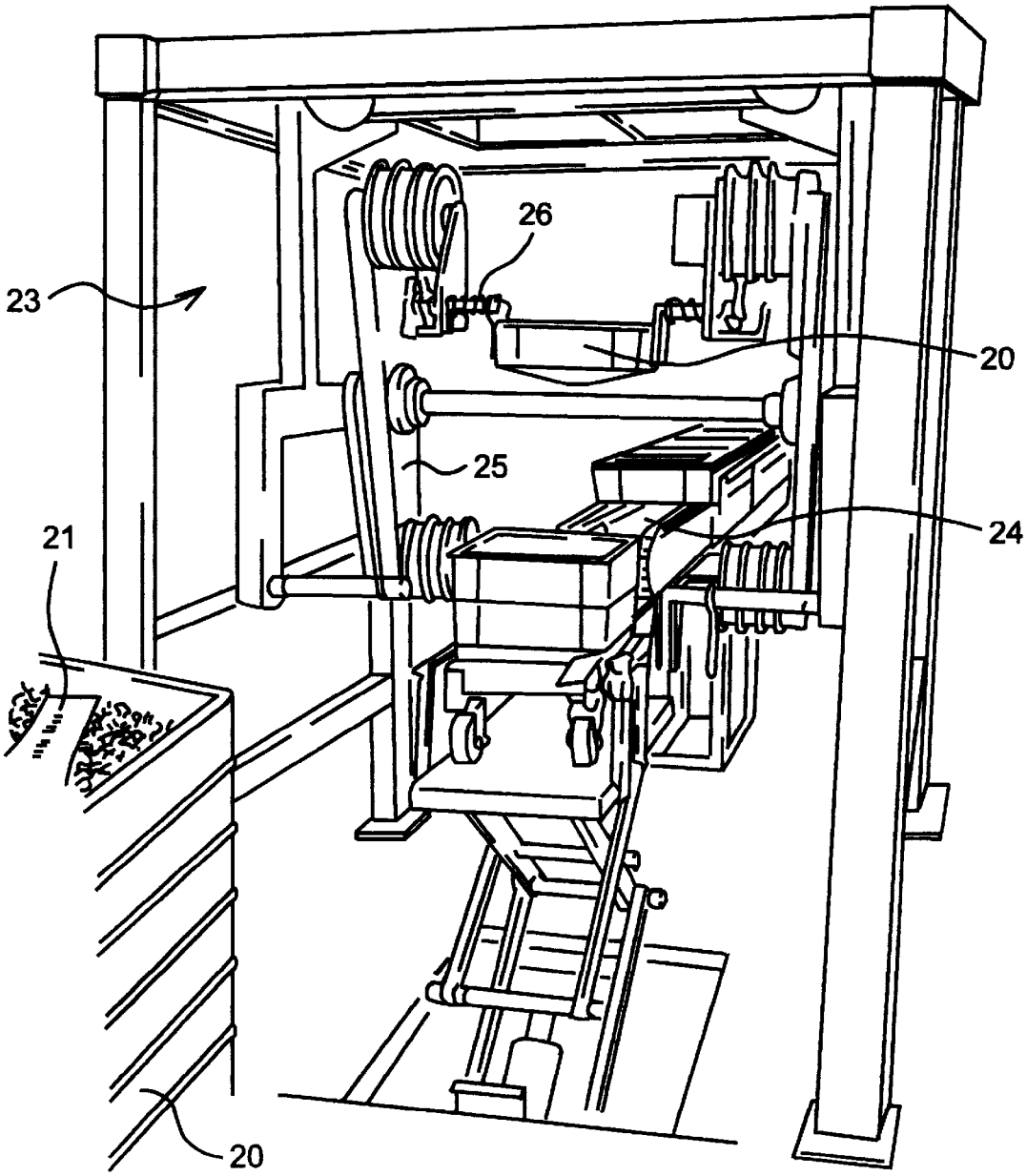
FIG. 5 is a perspective view of an automatic transfer device in the barrel plating apparatus.

Each box 20, provided with a corresponding kanban 21, is placed on a conveyor 24 by an automatic transfer device 23 shown at the extreme left in FIG. 1. As shown in FIG. 5, the automatic transfer device 23 according to this embodiment transfers one box 20 at a time from a stack of boxes 20 transported from the preceding process, by using a chuck 26 connected to distal ends of rotating arms 25. However, if the stacked boxes 20 contain pieces of the same item, it is also possible to transfer the stack of boxes 20 to conveyor 24.

Figure 6:
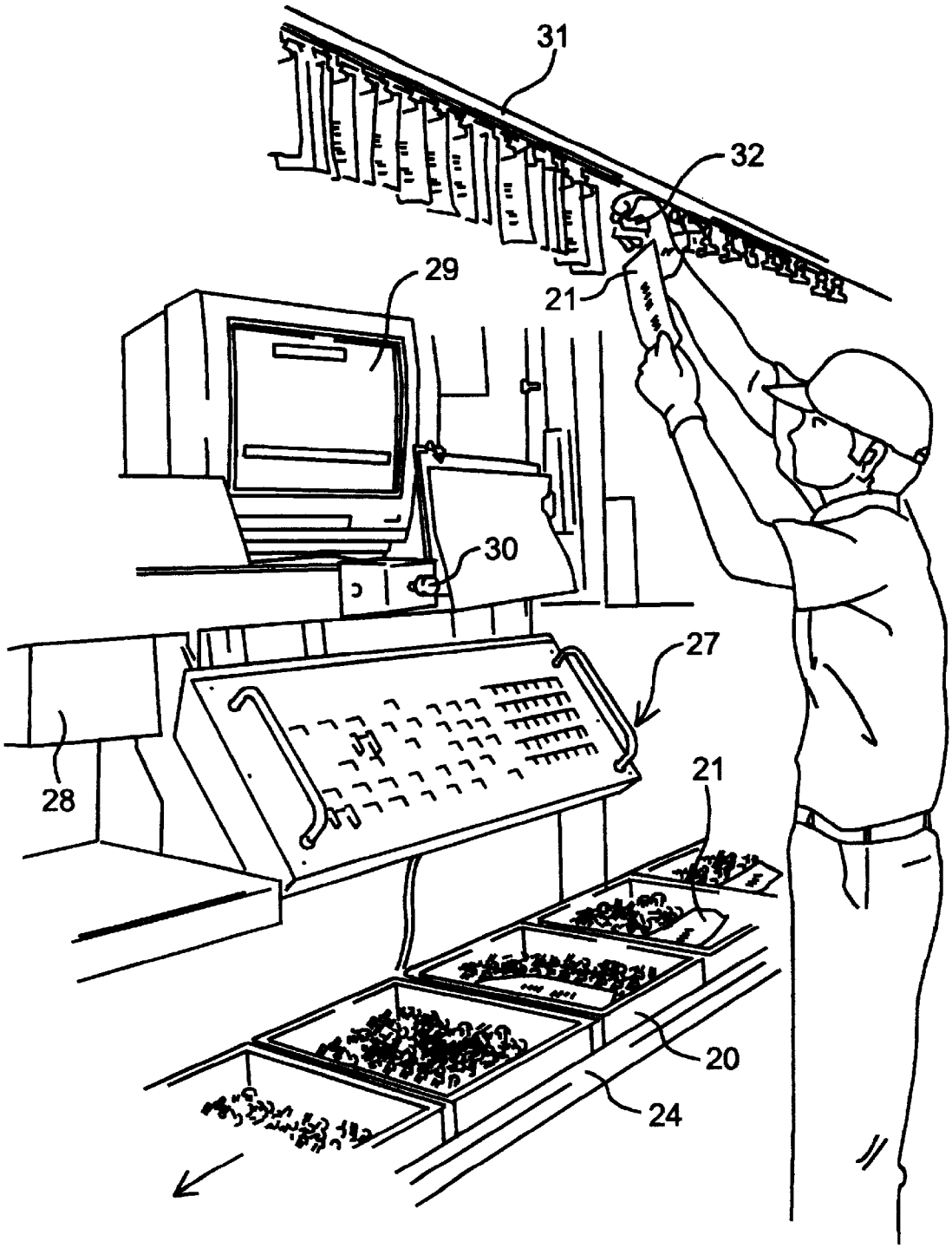
FIG. 6 is a perspective view of an input gate of the barrel plating apparatus.

Transferred onto the conveyor 24, each box 20 is serially conveyed to an input gate 27 located next to the automatic transfer device 23. An example of the input gate 27 is shown in FIG. 6. At the input gate 27, an operator picks up kanban 21 from each box 20, and operates the barcode reader 28 to read the content of the barcode of each kanban 21. The barcode reader 28 scans the item number, as well as other information regarding the item. The plating coefficient stored in the host computer in correspondence to the scanned item number is retrieved. The content of the kanban 21 read by the barcode reader 28 is displayed on computer display 29. The operator checks whether the displayed content corresponds to the item actually contained in the box 20. After checking that the displayed content corresponds to the item in the box 20, the operator presses an input confirmation button 30. After the content of the kanban 21 is properly inputted, the box 20 is conveyed toward the plating apparatus by the conveyor 24.

After picking up kanban 21 from each box 20, the operator hangs the kanban 21 on one of clips 32 hanging from rail 31 extending above the operating person. The rail 31 forms a continuous loop extending between the input gate 27 and a take-out conveyor 40. An operator at the take-out conveyor 40 serially takes each kanban 21 off clip 32, and places the kanban 21 in combination with the corresponding plated item. That is, since each kanban 21 is sequentially hung after the input of the content of the kanban 21 is confirmed, kanbans 21 are aligned along the rail 31 in the same order as the items (contained in barrels) processed in the barrel plating apparatus.

Figures 7, 7A:
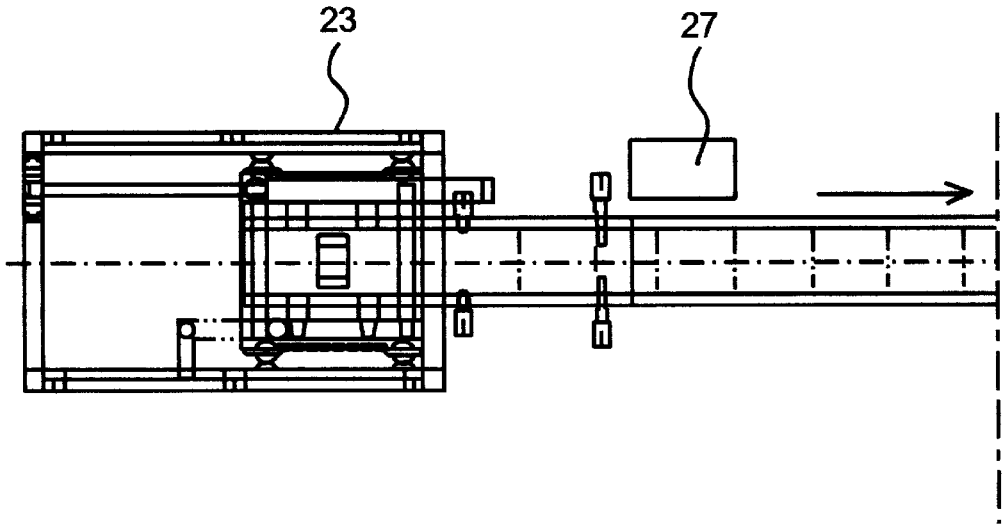
FIG. 7 is a plan view of a piece input section of the barrel plating apparatus.
Figure 7B:
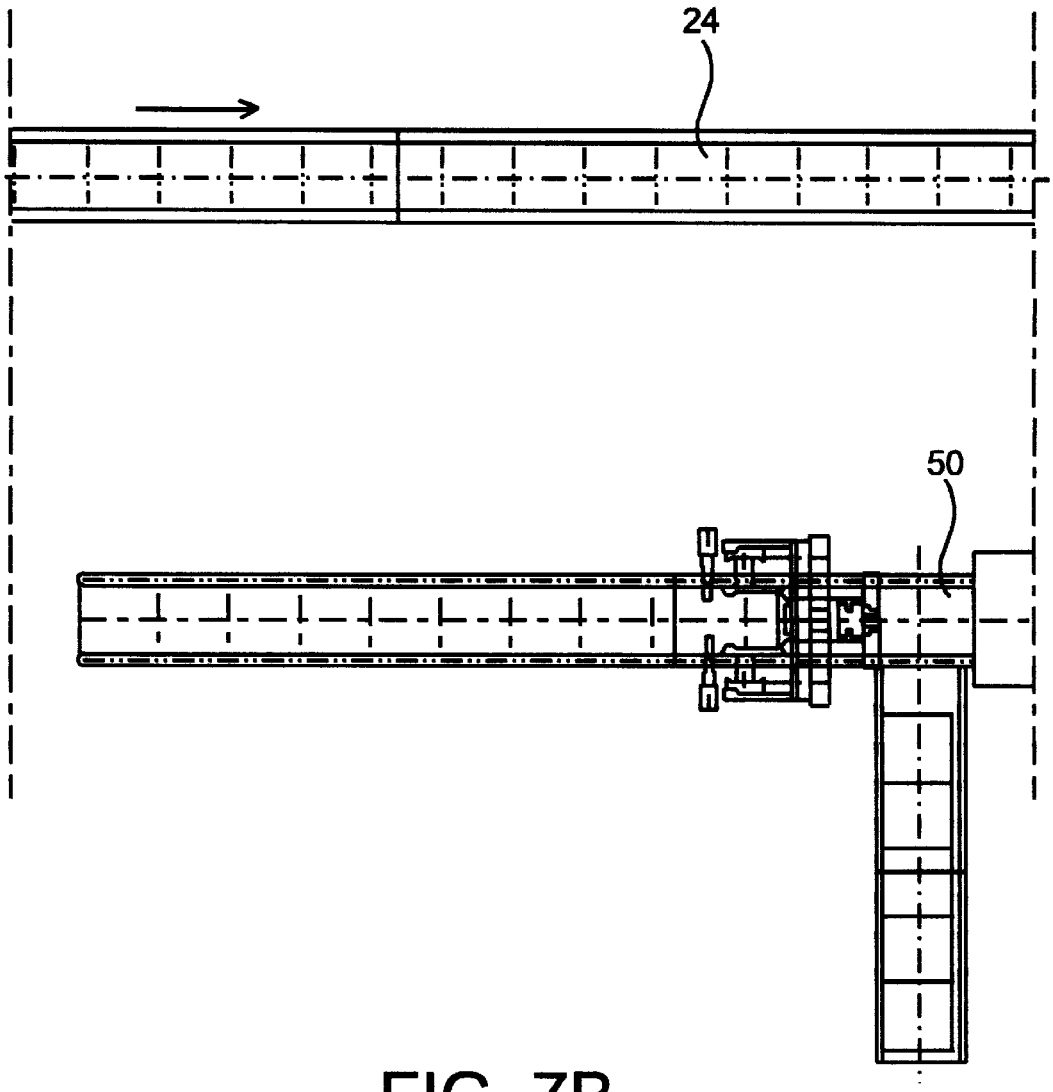
Figure 7C:
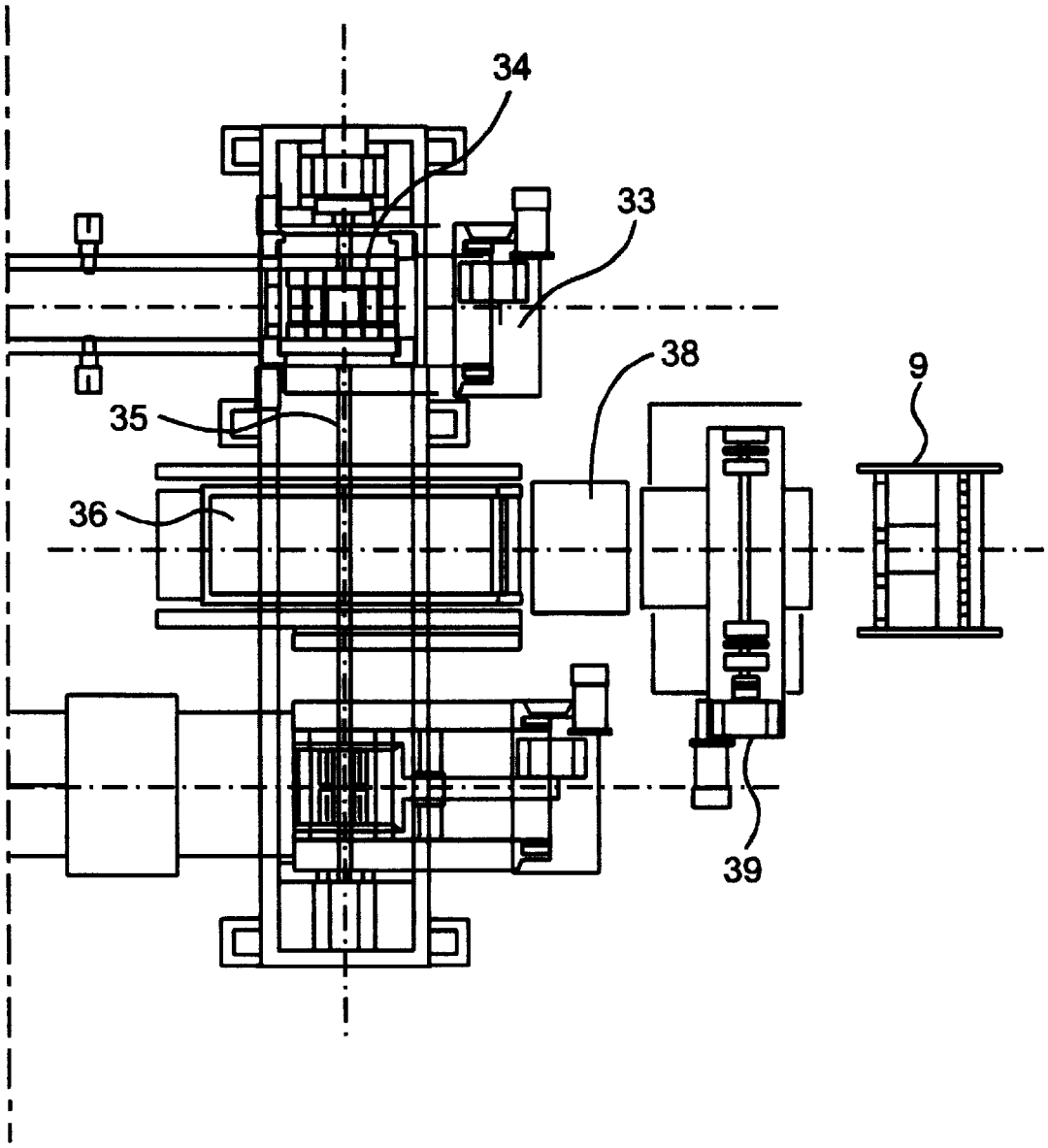
Figure 8A:
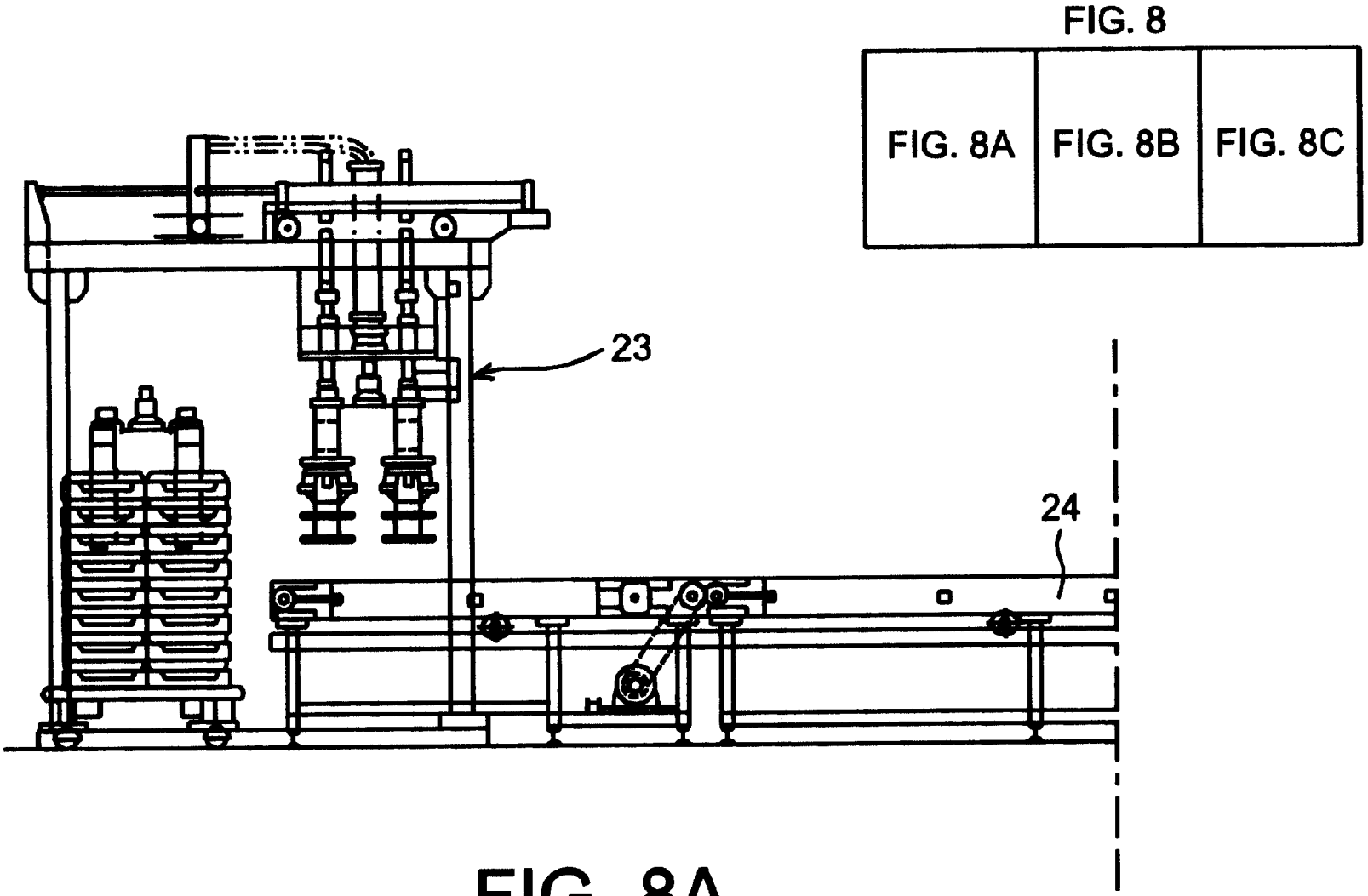
FIG. 8 is an elevation of the piece input section shown in FIG. 7.
Figure 8B:
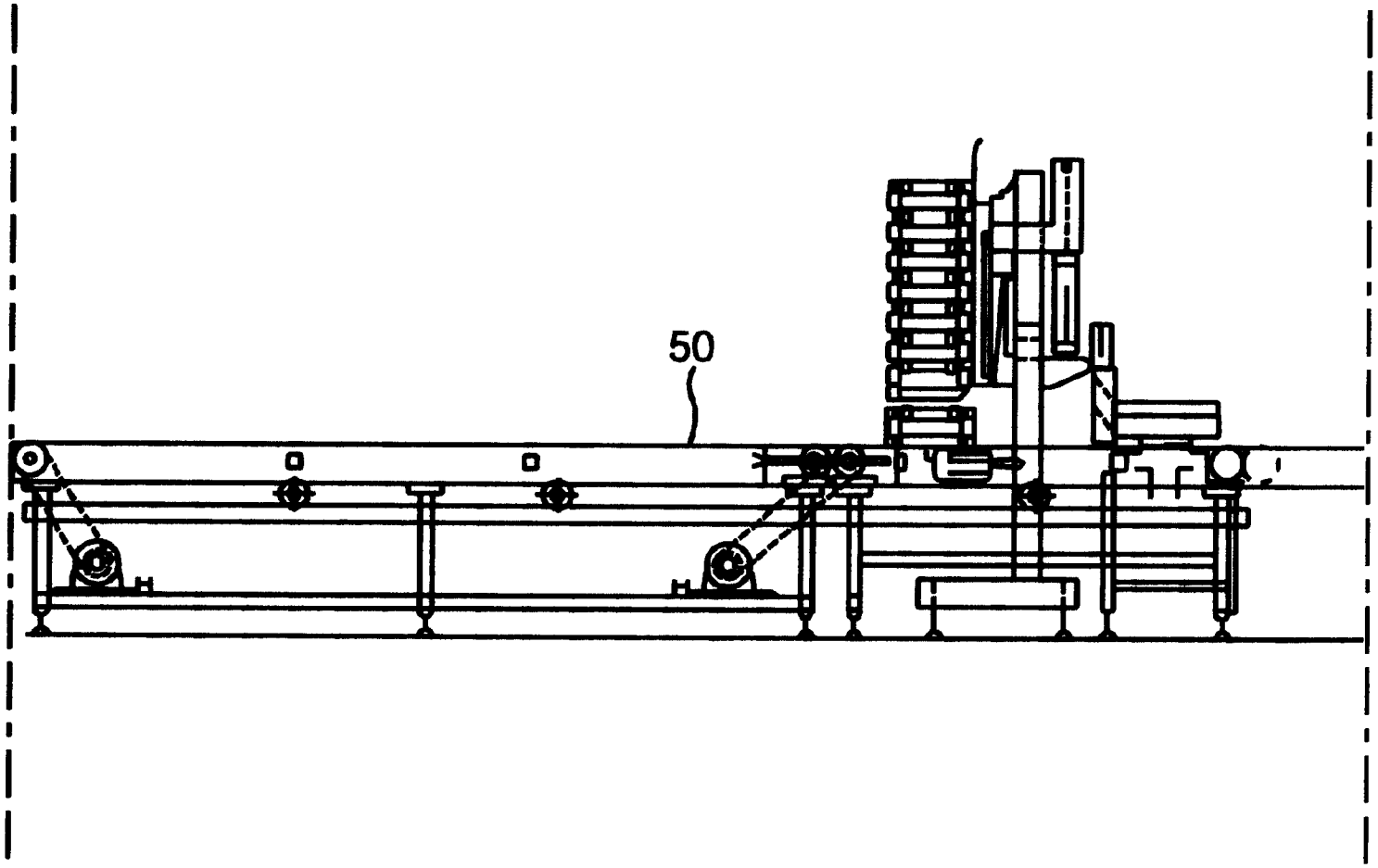
Figure 8C:
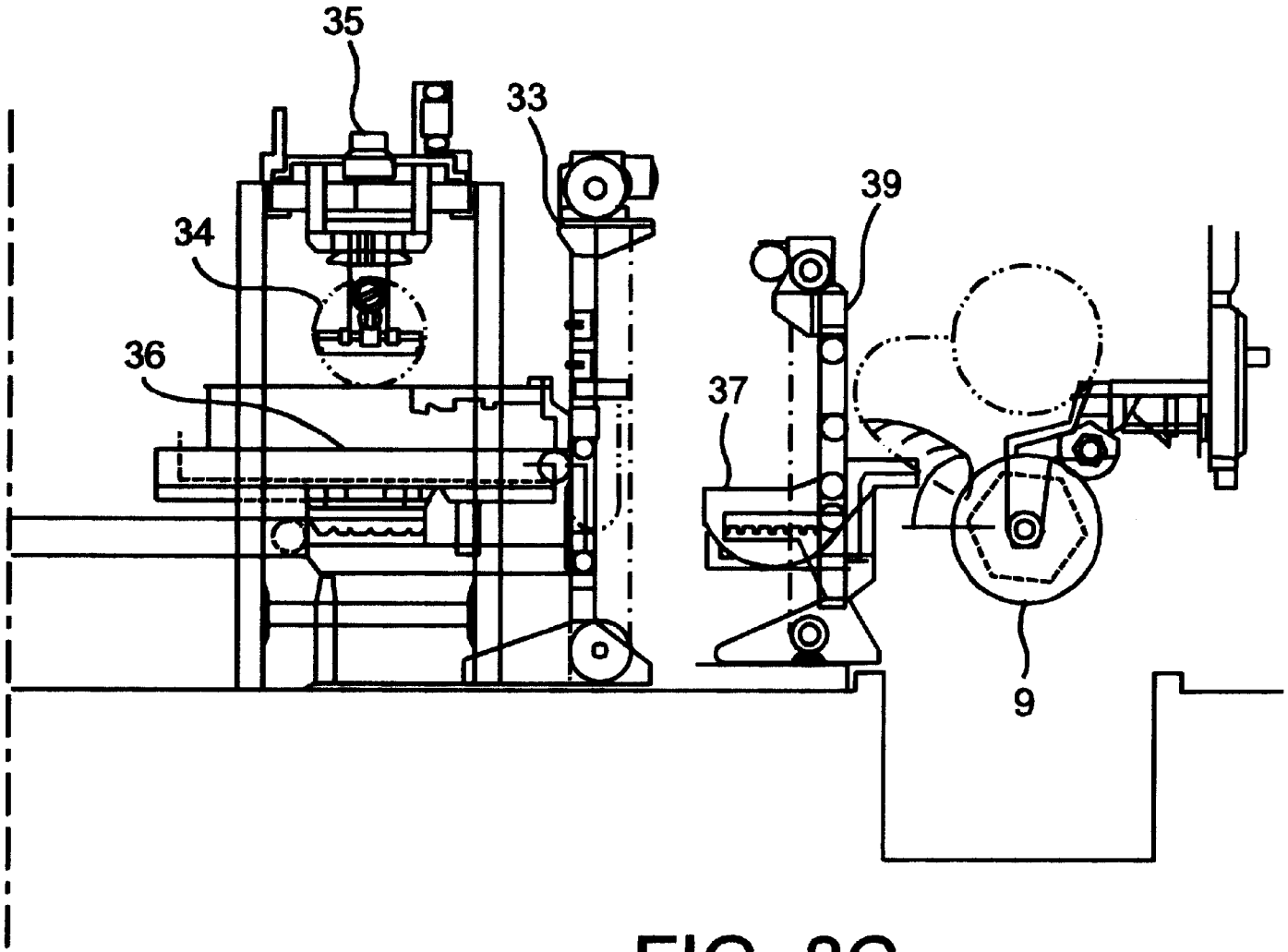

At the downstream end of the conveyor 24, each box 20 conveyed thereto is lifted by a lifter 33 as illustrated in FIGS. 7 and 8, and held by a chuck of an inverting device 34. The inverting device 34 has a moving shaft 35 that extends perpendicularly to the conveyor 24. Using the moving shaft 35, the inverting device 34 moves each box 20 from the conveyor 24, and inverts the box 20 over an input conveyor 36 so that the pieces fall from the box 20 over an input conveyor 36 onto the input conveyor 36. In this embodiment, since pieces from a few or several boxes may be put into one barrel 9, the pieces from a few or several boxes may be transferred from the input conveyor 36 into an input bucket 37. The weight of the pieces put into the input bucket 37 is measured by a weighing device 38. The pieces are then put into a barrel 9 from input bucket 37 by an input device 39. Each box 20, after being emptied, is moved by moving shaft 35 of inverting device 34 to an empty box conveyor 50.

The control apparatus automatically calculates a value of plating current (A) for each barrel 9 by multiplying the weight W (kg) of pieces in the barrel 9 measured from the weighing device 38, by the plating coefficient (A/kg) retrieved by using the barcode reader 28. The value of plating current is stored to a shift register or similar storage facility. Barrel plating is performed during the period between the entrance of the barrel 9 into the plating tank 3*a* and its exit therefrom by supplying a value of plating current from the power sources 16. The power sources are provided in one-to-one correspondence to the barrels that are dipped in the plating tank 3*a* one at a time. Therefore, even if each barrel 9 contains a different kind of piece or different item, it is possible to perform barrel plating by supplying plating current that is optimal for each barrel.

After being plated, the pieces from one barrel are removed therefrom into one basket. Subsequently, the pieces are subjected to centrifugal drying, dehydrogenation, a chromate treatment, and then again to centrifugal drying. After being distributed from the basket into a plurality of boxes by a distributing device 41, the pieces are checked by an operator at the entrance to the take-out conveyor 40. The operator takes kanbans 21 corresponding to the plated pieces, and puts them into boxes 20 so that the kanbans 21 correspond to the now-plated items in the boxes 20.

According to an embodiment of the invention, an operator needs to operate the apparatus to read the kanban 21 attached to or put in each box 20. Then, the apparatus automatically calculates the plating current for each barrel 9, and controls the electrification thereof, thereby plating to a film thickness optimal to the pieces in each barrel. Consequently, unlike the prior art, the invention eliminates variations in plating quality depending on the operator, and enables plating under optimal conditions even in a case where different barrels 9 contain different kinds of pieces.

While the present invention has been described with reference to certain embodiments thereof, it is understood that the invention is not limited to the specifically disclosed method or only to barrel plating apparatuses that have been descried herein. The invention is intended to cover various modifications and equivalent arrangements.

What is claimed is:

1. A barrel plating method for operating a plurality of plating barrels used to plate a plurality of articles, comprising the steps of:

grouping a plurality of articles to be plated into a plurality of containers;

providing each container with a kanban, said kanban bearing a value of a plating coefficient proportional to a value of current to be supplied according to a unit weight of the articles in that container;

transferring the plurality of articles from the plurality of containers to a plurality of barrels, each respective barrel being large enough to hold articles from more than one container;

automatically calculating a value of barrel-plating current for each respective barrel according to the value of a plating coefficient retrieved from the kanban of each container of articles transferred to each respective barrel, and the total weight of the articles in each respective barrel;

providing a plurality of power sources that correspond at least in number to the plurality of barrels; and performing barrel plating by supplying power to each barrel from one of the plurality of power sources, the value of barrel plating current so supplied being the valve having previously been calculated for each respective barrel.

2. A barrel plating method according to claim 1, wherein the plating coefficient is obtained as a multiplication of an average surface area per article, the number of articles per unit weight, and a plating current density for that article.

3. A barrel plating method according to claim 1 further comprising:

storing the value of the plating coefficient of each container in a host computer;

barcoding the kanban of each container with an item number; and scanning the barcoding on the kanban to retrieve the value of the plating coefficient for the articles in that container from the host computer.

* * * * *